US005133781A

United States Patent [19]

DeRosa et al.

[11] Patent Number: 5,133,781

[45] Date of Patent: Jul. 28, 1992

[54] COMPATIBILIZATION OF ASPHALTENES IN BITUMINOUS LIQUIDS USING BULK PHOSPHOALKOXYLATION

[75] Inventors: Thomas F. DeRosa, Passaic, N.J.; Rodney L. Sung, Fishkill, N.Y.; Benjamin J. Kaufman, Hopewell Junction, N.Y.; Eugene M. Jao, Fishkill, N.Y.

[73] Assignee: Texaco Inc., White Plains, N.Y.

[21] Appl. No.: 631,532

[22] Filed: Dec. 21, 1990

[51] Int. Cl.[5] ..... C10L 1/26

[52] U.S. Cl. ..... 44/300; 44/311; 208/22; 208/44

[58] Field of Search ..... 44/311, 281, 280, 300; 558/45, 46, 155, 156, 186, 198; 208/22, 44, 39; 552/262

[56] References Cited

U.S. PATENT DOCUMENTS

| | | | |
|---|---|---|---|
| 3,264,206 | 8/1966 | Ferris et al. | 208/44 |
| 3,275,586 | 9/1966 | Wurstner et al. | 208/44 |
| 3,575,932 | 4/1971 | Hedge et al. | 208/44 |
| 4,021,356 | 5/1977 | Kudchadker et al. | 208/44 |
| 4,182,613 | 1/1980 | Stover et al. | 44/281 |
| 4,399,024 | 8/1983 | Fukui et al. | 208/44 |
| 4,469,585 | 9/1984 | Cukier et al. | 208/22 |
| 4,842,716 | 6/1989 | Kaplan et al. | 208/44 |
| 4,885,381 | 12/1989 | Pawloski | 558/155 |

FOREIGN PATENT DOCUMENTS

| | | | |
|---|---|---|---|
| 0131858 | 3/1949 | Australia | 208/44 |
| 1142114 | 3/1983 | Canada | 208/44 |
| 50-105715 | 8/1975 | Japan | 208/44 |
| 0471025 | 8/1978 | U.S.S.R. | 208/44 |
| 0382842 | 11/1932 | United Kingdom | 208/44 |
| 2074146A | 10/1981 | United Kingdom | 208/44 |
| 2074147A | 10/1981 | United Kingdom | 208/44 |

OTHER PUBLICATIONS

CA85 (20):145533r.

*Primary Examiner*—Margaret Medley

*Attorney, Agent, or Firm*—Robert A. Kulason; James J. O'Loughlin; Vincent A. Mallare

[57] ABSTRACT

A method of compatibilization asphaltenes containing bituminous liquids which process comprises:

a) reacting an asphaltene with phosphorous trichloride in the presence of a liquid to form a phosphochlorinated asphaltene containing from about 0.01 wt % to about 20 wt. % phosphorous;

b) reacting the phosphochlorinated asphaltene with an equimolar amount of aliphatic or aromatic alcohols and phenols selected from the group consisting of:

i) an aliphatic alcohol;

ii) a naphthyl alcohol;

iii) an alkyl quinizarin;

iv) an oligomeric mixed polyether aliphatic terminal diol; and v) an oligomeric polyalkene terminal diol to produce a compatibilized asphaltene; and c) recovering the compatibilized asphaltene product.

24 Claims, No Drawings

COMPATIBILIZATION OF ASPHALTENES IN BITUMINOUS LIQUIDS USING BULK PHOSPHOALKOXYLATION

BACKGROUND OF THE INVENTION

This invention relates to asphaltenes, and more particularly to the compatibilization of asphaltenes in natural and processed bituminous liquids utilizing pendant groups that behave as solubilizers and dispersants to the asphaltenes.

DISCLOSURE STATEMENT

The art contains many disclosures on asphaltene characterization and modifications designed to compatibilize said material with bituminous liquids.

Article of FUEL, Volume 57, pgs. 25-28 (1978), teaches the art of asphaltenes compatibilization by the chemical incorporation of oxygen.

U.S. Pat. No. 4,182,613 discloses a method of compatibilizing asphaltic constituents in fuels by the addition of sediment-stabilizing alkylaryl sulfonic acids containing 10 to 70 carbon side chains.

Article of Journal of the American Oil Chemists Society, Volume 60, No. 7, pgs 1349-1359 (1983), teaches the art of coal dispersion in water through the use of polyamine surfactants.

U.S. Pat. No. 4,378,230 discloses a method compatibilizing Bunker "C" oil and water emulsions using dextrins.

U.S. patent application No. 648,328 discloses a method of generating organo-phosphorous compounds using trichlorophosphorous as the essential precursor.

British Patent 707,961 discloses methods designed to improve yields and to extend the range of applicability of producing organo-phosphorous compounds.

U.S. patent application 838,745 discloses functionalizing polyethylene using trichlorophosphorous and hydrolysis of the same using water-acetone mixtures.

Japanese Patent 5 9004-690-A discloses a method of stabilizing coal slurries by the modification of coal using polyether phosphoric ester salts.

The disclosures in the forgoing patents and research articles which relate to asphaltene compatibilization, namely U.S. patent applications Nos. 648,328 and 838,745; U.S. Pat. Nos. 4,182,613 and 4,378,230; British Patent 707,961; Japanese Patent 5 9004-690-A; Article of FUEL, Volume 57, pgs 25-28 (1978); and Article of Journal of the American Oil Chemists Society, Volume 60, No. 7, pgs 1349-1349 (1983) are incorporated herein by reference.

An object of this invention is to provide a method of stabilizing asphaltenes in Bunker "C" oil.

A further object of this invention is to provide a method of stabilizing asphaltenes in Bunker "C" oil containing Light Recycle Gas Oil.

SUMMARY OF THE INVENTION

This invention provides a method of compatibilizing asphaltenes containing bituminous liquids. The method comprises:

a) reacting an asphaltene with phosphorous trichloride to produce a phosphochlorinatedasphaltene containing from about 0.01 wt. % to about 20 wt. % phosphorous;

b) reacting said phosphorchlorinated-asphaltene with equimolar amounts of aliphatic or aromatic alcohols and phenols selected from the group consisting of:

(i) an aliphatic alcohol represented by the structural formula:

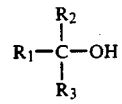

where $R_1$, $R_2$, and $R_3$ each are hydrogen or a ($C_1$-$C_{10}$) branched or linear hydrocarbon selected from the group consisting of alkyl, alkenyl, alkoxyl, alaryl, aralkyl, hydroxylalkyl, and aminoalkyl;

(ii) a naphthyl alcohol represented by the structural formula:

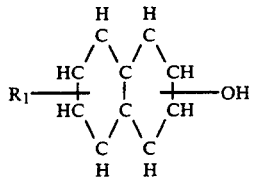

where $R_1$ is hydrogen or a ($C_1$-$C_{10}$) branched or linear hydrocarbon selected from the group consisting of alkyl, alkenyl, alkoxyl, hydroxylalkyl, and aminoalkyl;

(iii) an alkyl quinizarin represented by the structural formula:

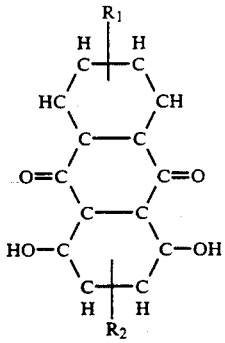

where $R_1$ and $R_2$ each are hydrogen or a branched or linear hydrocarbon selected from the group consisting of alkyl, alkenyl, alkoxyl, aralkyl, alaryl, hydroxylalkyl, and aminoalkyl;

iv) an oligomeric mixed polyether aliphatic terminal diol represented by the structural formula:

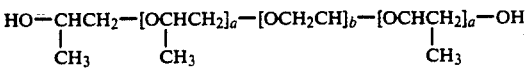

where a and b are independent of each other, and a varies from 1 to 50 and b varies from up to 100; and v) an oligomeric polyalkene terminal diol represented by the structural formula:

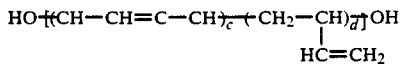

where c and d are in an approximate ratio of 1:100 to 100:1 and c and d vary from 1 to 600 to produce a compatibilized asphaltene; and (c) recovering the compatibilized asphaltene product.

Asphaltenes that have been phosphochlorinated and then post-reacted with one or more of the aforementioned alcohols are characterized as being compatible with Bunker "C" oil or Bunker "C" oil blended with Light Recycle Gas Oil.

DETAILED DESCRIPTION OF THE INVENTION

Asphaltenes are components of the bitumen in petroleum, petroleum products, and other bituminous materials which are soluble in carbon disulfide but insoluble in paraffin naphtha. The physical and chemical characteristics of asphaltenes have been the subject of considerable investigation for at least a century. The asphaltene molecule appears to carry a core of approximately five stacked flat sheets of condensed aromatic rings, one above the other giving an overall height of 16–20 angstroms. The average sheet diameter appears to be about 8.5 to 15 angstroms. The molecular weight of petroleum asphaltenes ranges from about 1,000 to 10,000.

Shale oil asphaltenes appear to have a lower molecular weight.

Qualitative and semiquantitative detection of asphaltenes and bituminous liquids, e.g. petroleum and petroleum derived liquids, is conventionally carried out by observing the precipitation of asphaltenes by naphtha addition.

The presence of asphaltenes in bituminous liquid, e.g. petroleum crude, refinery streams, and other natural and processed bituminous liquids, is well known as are the problems resolving from the presence and precipitation of the asphaltenes. In petroleum production, for example, it has long been known that asphaltenes may, under some circumstances, precipitate to form a sludge which plugs up the oil bearing formation and prevents the recovery of additional petroleum. Sludge in such compositions is known to form in petroleum bearing formations, on valves, pump impellers, in conduits, and in other bituminous liquid handling equipment.

Generally, it is regarded as an advantage to keep the asphaltenes in a stable suspension in the bituminous liquid until well into the refining process. This not only increases the ultimate yield but prevents or reduces maintenance problems and also improves productivity from bituminous liquid bearing formations.

Our method for improving the compatibility of asphaltenes in Bunker "C" oil and Bunker "C" oil blends entails bulk phosphochlorination of the asphaltene followed by bulk of the phosphochlorinated-asphaltene intermediate. This invention constitutes a method for stabilizing asphaltenes in petroleum, shale oil, refinery streams, and other bituminous liquids. This two step process is outlined below:

Step 1

Phosphochlorination of Asphaltene

Asphaltene is initially dissolved in tetrahydrofuran (THF) and phosphochlorinated using phosphorous trichloride.

Asphaltene dissolution in THF permits extensive and homogeneous asphaltene phosphochlorination.

Phosphochlorination using PC13 is shown below in Equation 1 (Eq.1).

Eq.1:

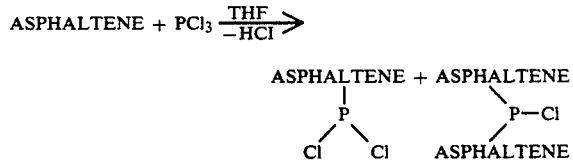

Step 2

Alkoxylation of Phosphochlorinated Asphaltene

Phosphochlorinated asphaltenes react readily with oligomeric polyethers and alcohols generating phospho-alkoxylated asphaltenes. Post-reaction of phosphochlorinated asphaltene with an oligomeric polyether diol is shown below in Equation 2 (Eq. 2).

Eq.2:

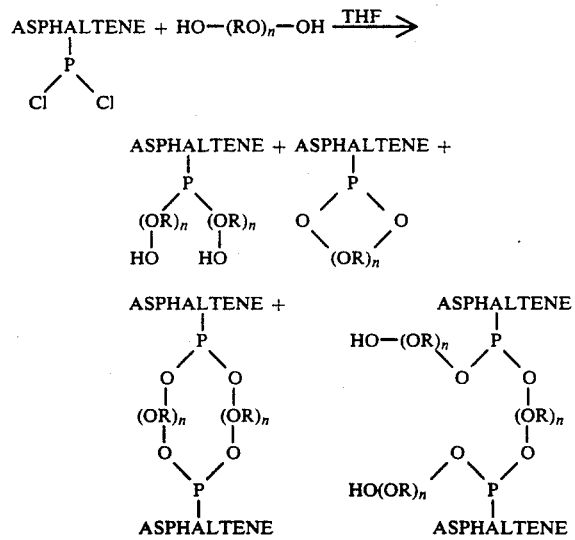

The present compatibilization differs from other methods since the phosphochlorination and alkoxylation are homogenuously distributed throughout the asphaltene. Other methods that have attempted to compatibilize asphaltenes are more aptly characterized as homogeneous surface modifications containing surface active agents.

Additional experiments were also performed in order to underscore the need to chemically modify the asphaltene in order to improve their compatibility in bituminous liquids. More specifically, the rationale that was used in the following Examples is outlined below:

a) Blends of I wt. % and 2 wt. % unmodified asphaltenes in Bunker "C" oil and Bunder "C" oil containing Light Recycle Recycle Gas Oil were assayed as baseline data. These test results appear below in Table I.

b) Blends of 1 wt. % to 2 wt. % phospho-alkoxylated asphaltenes and Bunker "C" oil and Bunker "C" oil containing Light Recycle Gas Oil were prepared and evaluated for enhanced compatibility. These tests reflect the effect of the bulk chemical modification of the asphaltene. These test results appear below in Tables II, III, IV, and V.

c) Blends of physical mixtures of unmodified asphaltenes and alkyl- or aromatic phosphites in bituminous liquids were evaluated for compatibility. These tests are designed to measure the effect on compatibilization alkyl- or aromatic phosphite mixtures have on unmodified asphaltenes. These test results appear below in Table VI.

d) Bituminous liquids were phospho-alkoxylated and then blended with unmodified asphaltenes. These tests were designed to measure the effect on compatibilization of unmodified asphaltenes with phospho-alkoxylated bituminous liquids. These test results appear below in Table VII.

e) Alkyl- and aromatic phosphite surface active agents were incorporated onto the asphaltene surface and compatibility assayed for enhanced asphaltene compatibilization. These tests were designed to measure the effect surface active agents have upon asphaltene compatibilization in bituminous liquids. These test results appear below in Table VIII.

In the Examples, the terms used for various materials are trade names of products (such as "PPG-" and "PolyBd") manufactured and sold, respectively, by Texaco Chemical Company of Houston, Tex. and Arco, Inc. of Philadelphia, Pa. and defined as follows:

PPG-400 is a poly propylene glycol having a molecular weight of 400;

2) PPG-1000 is a poly propylene glycol having a molecular weight of 1000;

3) PPG-2000 is a poly propylene glycol having a molecular weight of 2000; and

4) Poly BD diol (Mn=2000 amu) is a poly butadiene diol having a molecular weight of 2000.

EXAMPLE I

Preparation of Phosphochlorinated-Asphaltene

Asphaltenes were obtained from Bunker "C" oil by extracting using n-heptane which were thoroughly dried and ground to 40 mesh powder.

Phosphochlorinations were performed by adding 0.1 to 10 wt. % neat $PCl_3$ to stirred solutions of 1 to 10 wt. % asphaltenes dissolved in THF at reflux temperature under anhydrous conditions. The mixture was permitted to react under these conditions from 1 to 75 hours. Phosphochlorinated asphaltenes when then isolated by removing unreacted $PCl_3$ and THF through atmospheric or vacuum distillation. This intermediate was stored under anhydrous conditions pending subsequent reaction.

EXAMPLE II

Sufficient naphthyl alcohol is dissolved in 50 to 500 mls anhydrous THF and added to phosphochlorinated asphaltenes derived from the aforementioned example to cause complete alkoxylation to occur. The phosphonaphylated asphaltene is isolated through atmospheric or vacuum distillation.

EXAMPLE III

Preparation of Phospho-(Polyether)-Asphaltene

In this example, PPG-400 was substituted for the naphthyl alcohol in Example II to produce phospho-(polyether)-asphaltene.

EXAMPLE IV

Preparation of Phospho-(Polyether)-Asphaltene

In this example, PPG-1000 was substituted for the naphthyl alcohol in Example II, to produce phospho-(polyether)asphaltene.

EXAMPLE V

Preparation of Phospho-(Polyether)-Asphaltene

In this example, PPG-2000 was substituted for the naphthyl alcohol in Example II, to produce phospho-(polyether)asphaltene.

EXAMPLE VI

Preparation of Phospho-decylated Asphaltene

In this example, decyl alcohol was substituted for the naphthyl alcohol in Example II, to produce phospho-decylated asphaltene.

EXAMPLE VII

Preparation of Phospho-Nonylated-Asphaltene

In this example, nonyl alcohol was substituted for the naphthyl alcohol in Example II, to produce phospho-nonylated-asphaltene.

EXAMPLE VIII

Preparation of Phospho-Quinizarinated-Asphaltene

In this example, quinizarin was substituted for the naphthyl alcohol in Example II, to produce phosphoquinizarinated-asphaltene.

EXAMPLE IX

Preparation of Phospho-(Poly BD)-Asphaltene

In this example, polyBD diol was substituted for the naphthyl alcohol in Example II, to produce phospho-(poly BD)-asphaltene.

EXAMPLE X

Surface phosphochlorinations of asphaltenes were performed by the addition of neat $PCl_3$ to 1 wt. % to 10 wt. % stirred slurries of asphaltene in n-heptane at reflux temperatures under anhydrous conditions. Surface phospho-alkoxylated asphaltene was isolated by filtration.

EXAMPLE XI

Sufficient naphthyl alcohol was added to a vigorously stirred solution to cause complete surface phospho-naphthylation. The material was isolated by filtration.

EXAMPLE XII

Preparation of Surface Phospho-(Polyether)-Asphaltene

In this example, PPG-400 was substituted for the naphthyl alcohol in EXAMPLE XI, to produce surface phospho(Polyether)-asphaltene.

EXAMPLE XIII

Preparation of Surface Phospho-(Polyether)-Asphaltene

In this example, PPG-1000 was substituted for the naphthyl alcohol in Example XI, to produce surface phospho(polyether)-asphaltene.

EXAMPLE XIV

Preparation of Surface Phospho-(Polyether)-Asphaltene

In this example, PPG-2000 was substituted for the naphthyl alcohol in Example XI, to produce surface phospho(polyether)-asphaltene.

EXAMPLE XV

Preparation of Surface Phospho-Decylated-Asphaltene

In this example, decyl alcohol was substituted for the naphthyl alcohol in Example XI, to produce surface phosphodecylated-asphaltene.

EXAMPLE XVI

Preparation of surface Phospho-Nonylated-Asphaltene

In this example, nonyl alcohol was substituted for the naphthyl alcohol in Example XI, to produce surface phosphononylated-asphaltene.

EXAMPLE XVII

Preparation of Surface Phospho-Quinizarinated-Asphaltene

In this example, quinizarin was substituted for the naphthyl alcohol in Example XI, to produce surface phosphoquinizarinated-asphaltene.

EXAMPLE XVIII

Preparation of surface Phospho-(Poly BD)-Asphaltene

In this example, polyBD diol was substituted for the naphthyl alcohol in Example XI, to produce surface phospho-(poly BD)-asphaltene.

EXAMPLE XIX

Phosphoalkoxylations prepared in Bunker "C" oil utilized material stoichiometry outlined above in Examples 1 and 2. Unmodified asphaltenes were dissolved in THF and added to Bunker "C" phosphoalkoxylated material; THF was removed by heating gently this mixture under atmospheric pressure.

The novel reaction products of this invention were evaluated according to the Spot Test as outlined in the ASTM D 2781 test method. In the spot test, Bunker "C" oil or Bunker "C" blend containing Light Recycle Gas Oil and the modified or unmodified asphaltene are heated to 150° C. for a specified time and the sample removed and agitated for a specified duration. One drop of the mixture is placed onto a sheet of filter paper using a glass rod. The filter paper is baked in the oven and oil diffuses radically from the point of addition to give a uniform brown circle. Any asphaltenes which have precipitated during this process appear as a ring of darker material. The sample is rated using integers on a scale of one though five, the higher numbers indicating that precipitation has occurred.

Tables I through VIII, below, provide a summary of these spot test results.

TABLE 1

Spot Testing Results Using ASTM Test Method D 2781 For Unmodified Asphaltene Samples Used As References.

| Sample | Spot Test Rating |
|---|---|
| 1 wt % Asphaltene + 99 wt % Bunker "C" oil | 3 |
| 2 wt % Asphaltene + 98 wt % Bunker "C" oil | 3 |
| 1 wt % Asphaltene + 99 wt % 4:1 wt/wt Light Recycle Gas Oil and Bunker "C" oil | 3 |
| 2 wt % Asphaltene + 98 wt % 4:1 wt/wt Light Recycle Gas Oil and Bunker "C" oil | 3 |

TABLE II

Spot Test Results Using ASTM Test Method D 2781 And A 1 wt % Sample In Bunker "C" Oil.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + PPG-2000 | 1 |
| Phosphochlorinated Asphaltene + Decyl Alcohol | 1 |
| Phosphochlorinated Asphaltene + Nonyl Phenol | 1 |
| Phosphochlorinated Asphaltene + 1-Naphthyl Alcohol | 1 |
| Phosphochlorinated Asphaltene + Quinizarin | 1 |
| Phosphochlorinated Asphaltene + PolyBD diol (Mn = 2000 amu) | 1 |

TABLE III

Spot Test Results Using ASTM Test Method D 2781 And A 2 wt % Sample in Bunker "C" Oil.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + PPG-2000 | 1 |
| Phosphochlorinated Asphaltene + Decyl Alcohol | 1 |
| Phosphochlorinated Asphaltene + Nonyl Phenol | 1 |
| Phosphochlorinated Asphaltene + 1-Naphthyl Alcohol | 3 |
| Phosphochlorinated Asphaltene + Quinizarin | 1 |
| Phosphochlorinated Asphaltene + PolyBD diol (Mn = 2000 amu) | 1 |

TABLE IV

Spot Test Results Using ASTM Test Method D 2781 And A 1 Wt % Sample In A 4:1 wt/wt Blend Of Light Recycle Gas Oil And Bunker "C" Oil, Respectively.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + PPG-2000 | 1 |
| Phosphochlorinated Asphaltene + Decyl Alcohol | 1 |
| Phosphochlorinated Asphaltene + Nonyl Phenol | 1 |
| Phosphochlorinated Asphaltene + 1-Naphthyl Alcohol | 3 |
| Phosphochlorinated Asphaltene + Quinizarin | 1 |
| Phosphochlorinated Asphaltene + PolyBD diol (Mn = 2000 amu) | 1 |

TABLE V

Spot Test Results Using ASTM Test Method D 2781 And A 2 wt % Sample In A 4:1 wt/wt Blend Of Light Recycle Gas Oil And Bunker "C" Oil, Respectively.

| Sample | Spot Test Rating |
|---|---|
| Phosphochlorinated Asphaltene + PPG-400 | 1 |
| Phosphochlorinated Asphaltene + PPG-1000 | 1 |
| Phosphochlorinated Asphaltene + PPG-2000 | 1 |
| Phosphochlorinated Asphaltene + Decyl Alcohol | 1 |
| Phosphochlorinated Asphaltene + Nonyl Phenol | 1 |
| Phosphochlorinated Asphaltene + 1-Naphthyl Alcohol | 2 |
| Phosphochlorinated Asphaltene + Quinararin | 1 |

TABLE V-continued

Spot Test Results Using ASTM Test Method D 2781 And A 2 wt % Sample In A 4:1 wt/wt Blend Of Light Recycle Gas Oil And Bunker "C" Oil, Respectively.

| Sample | Spot Test Rating |
|---|---|
| Phosphochlorinated Asphaltene + PolyBD diol (Mn = 2000 amu) | 1 |

TABLE VI

Spot Test Results Using ASTM Test Method D 2781 For Unmodified Asphaltenes And Bunker "C" Oil Containing Physical Blends Of 1 Or 2 Wt % Trialiphatic Or Triaromatic Phosphites.

| Sample | Spot Test Rating |
|---|---|
| Asphaltene + 1 wt % blend of tri(PPG-400)phosphite | 3 |
| Asphaltene + 2 wt % blend of tri(PPG-400)phosphite | 3 |
| Asphaltene + 1 wt % blend of tri(n-decoxy)phosphite | 3 |
| Asphaltene + 2 wt % blend of tri(n-decoxy)phosphite | 3 |
| Asphaltene + 1 wt % blend of tri(quinarazin)phosphite | 3 |
| Asphaltene + 2 wt % blend of tri(quinarazin)phosphite | 3 |
| Asphaltene + 1 wt % blend of tri(nonylphenoxy) phosphite | 3 |
| Asphaltene + 2 wt % blend of tri(nonylphenoxy) phosphite | 3 |

TABLE VII

Spot Test Results Using ASTM Test Method D 2781 For Physical Blends Of Trialkyl- Or Triarylphosphite Compounds Prepared In Bunker "C" Oil And Unmodified Asphaltenes.

| Sample | Spot Test Rating |
|---|---|
| Asphaltene + Bunker C oil containing 1 wt % tri (PPG-400)phosphite | 3 |
| Asphaltene + Bunker C oil containing 2 wt % tri (PPG-400)phosphite | 3 |
| Asphaltene + Bunker C oil containing 1 wt % tri(n-decoxy)phosphite | 3 |
| Asphaltene + Bunker C oil containing 2 wt % tri(n-decoxy)phosphite | 3 |
| Asphaltene + Bunker C oil containing 1 wt % tri(quinarin)phosphite Insoluble | 3 |
| Asphaltene + Bunker C oil containing 2 wt % tri(quinarin)phosphite Insoluble | 3 |
| Asphaltene + Bunker C oil containing 1 wt % Tri(nonylphenol)phosphite | 3 |
| Asphaltene + Bunker C oil containing 2 wt % Tri(nonylphenol)phosphite | 3 |

TABLE VIII

Spot Testing Results Using ASTM Test Method D 2781 For Asphaltenes Containing Surface Active Agents.

| Sample | Spot Test Rating |
|---|---|
| Phosphochlorinated Asphaltene Slurry + PPG-400 | 3 |
| Phosphochlorinated Asphaltene Slurry + Decyl Alcohol | 3 |
| Phosphochlorinated Asphaltene Slurry + PolyBD diol (Mn = 2000 amu) | 2 |
| Phosphochlorinated Asphaltene Slurry + Nonylphenol | 1 |

As the forgoing data indicate, amidation of bulk phosphochlorinated asphaltenes causes dramatic compatibilization in Bunker "C" oil and Bunker "C" oil blends containing Light Recycle Gas Oil. Less dramatic results are obtained by the incorporation of surface active agents onto asphaltenes. Finally, little emulsifying effect was observed by blending unmodified asphaltenes with Bunker "C" oil and oil blends containing amidated trichlorophosphorous.

What is claimed:

1. A method of compatibilization of asphaltenes containing bituminous liquids comprising the steps:

A) reacting an asphaltene with phosphorous trichloride in the presence of the liquid to produce a phosphochlorinated-asphaltene containing from 0.01 wt. percent to 20 wt. percent phosphorous, and B) reacting said phosphochlorinated-asphaltene with equimolar amounts of aliphatic or aromatic alcohols and phenols selected from the group consisting of:

i) an aliphatic alcohol represented by the structural formula:

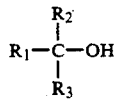

where $R_1$, $R_2$, and $R_3$ each are hydrogen or ($C_1$–$C_{10}$) branched or linear hydrocarbon selected from the group consisting of alkyl, alkenyl, alkoxyl, alaryl, aralkyl, hydroxylalkyl, and aminoalkyl;

ii) a naphthyl alcohol represented by the structural formula:

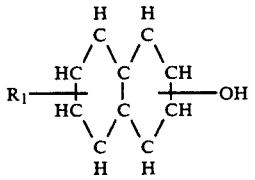

where $R_1$ is hydrogen or a ($C_1$–$C_{10}$) branched or linear hydrocarbon selected from the group consisting of alkyl, alkenyl, alkoxyl, hydroxylalkyl, and aminoalkyl;

iii) a quinizarin represented by the structural formula:

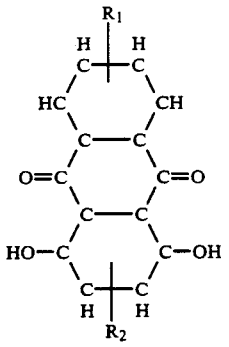

where $R_1$ and $R_2$ each are hydrogen or a ($C_1$–$C_{10}$) branched or linear hydrocarbon selected from the group consisting of alkyl, alkenyl, alkoxyl, aralkyl, alaryl, hydroxylalkyl, and aminoalkyl;

iv) an oligomeric mixed polyether aliphatic terminal diol represented by the structural formula:

$$HO-\underset{\underset{CH_3}{|}}{CH}CH_2-[O\underset{\underset{CH_3}{|}}{CH}CH_2]_a-[OCH_2CH_2]_b-[O\underset{\underset{CH_3}{|}}{CH}CH_2]_a-OH$$

where a and b are independent of each other, and a varies from 1 to 50 and b varies up to 100;

v) an oligomeric polyalkene terminal diol represented by the structural formula:

$$HO-[(CH-CH=C-CH)_c-(CH_2-\underset{\underset{HC=CH_2}{|}}{CH})d_d]-OH$$

where c and d are in an approximate ratio of 1:100 to 100:1, respectively, and c and d vary from 1 to 600, to produce a compatibilized asphaltene; and c) recovering said compatibilized asphaltene product.

2. The method according to claim 1 where the phosphorous content is from about 0.10 wt. percent to about 10 wt. percent.

3. The method according to claim 2 in which said aliphatic alcohol is decyl alcohol.

4. The method according to claim 2 in which said aliphatic alcohol is nonyl alcohol.

5. The method according to claim 2 in which said naphthyl alcohol is 1-naphthyl alcohol.

6. The method according to claim 2 in which said oligomeric mixed polyether aliphatic terminal diol is a poly propylene glycol having a molecular weight of 400.

7. The method according to claim 2 in which said oligomeric mixed polyether aliphatic terminal diol is a poly propylene glycol having a molecular weight of 1000.

8. The method according to claim 2 in which said oligomeric mixed polyether aliphatic terminal diol is a poly propylene glycol having a molecular weight of 2000.

9. The method according to claim 2 in which said oligomeric polyalkene terminal diol is a poly butadiene diol with a molecular weight of 1800.

10. The method according to claim 1 wherein the phosphorous content is from 1 to 5 wt. percent.

11. The method according to claim 10 in which said aliphatic alcohol is decyl alcohol.

12. The method according to claim 10 in which said aliphatic alcohol is nonyl alcohol.

13. The method according to claim 10 in which said naphthyl alcohol is 1-naphthyl alcohol.

14. The method according to claim 10 in which said oligomeric mixed polyether aliphatic terminal diol is a poly propylene glycol having a molecular weight of 400.

15. The method according to claim 10 in which said oligomeric mixed polyether aliphatic terminal diol is a poly propylene glycol having a molecular weight of 1000.

16. The method according to claim 10 in which said oligomeric mixed polyether aliphatic terminal diol is a poly propylene glycol having a molecular weight of 2000.

17. The method according to claim 10 in which said oligomeric polyalkene terminal diol is a poly butadiene diol with a molecular weight of 1800.

18. The method according to claim 1 in which said aliphatic alcohol is decyl alcohol.

19. The method according to claim 1 in which said aliphatic alcohol is nonyl alcohol.

20. The method according to claim 1 in which said naphthyl alcohol is 1- naphthyl alcohol.

21. The method according to claim 1 in which said oligomeric mixed polyether aliphatic terminal diol is a poly propylene glycol having a molecular weight of 400.

22. The method according to claim 1 in which said oligomeric mixed polyether aliphatic terminal diol is a poly propylene glycol having a molecular weight of 1000.

23. The method according to claim 1 in which said oligomeric mixed polyether aliphatic terminal diol is a poly propylene glycol having a molecular weight of 2000.

24. The method according to claim 1 in which said oligomeric poly-alkene terminal diol is a poly butadiene diol with a molecular weight of 1800.

* * * * *